US009989340B2

(12) United States Patent
Grassi et al.

(10) Patent No.: US 9,989,340 B2
(45) Date of Patent: Jun. 5, 2018

(54) LOW-WEIGHT SMALL-FORM-FACTOR STUN GRENADE

(71) Applicants: Michael J. Grassi, Columbus, OH (US); Jacob Kravel, Great Neck, NY (US); Thomas S. Guyer, Painesville, OH (US)

(72) Inventors: Michael J. Grassi, Columbus, OH (US); Jacob Kravel, Great Neck, NY (US); Thomas S. Guyer, Painesville, OH (US)

(73) Assignee: Combined Systems Inc., Jamestown, PA (US)

( * ) Notice: Subject to any disclaimer, the term of this patent is extended or adjusted under 35 U.S.C. 154(b) by 0 days. days.

(21) Appl. No.: 15/257,205

(22) Filed: Sep. 6, 2016

(65) Prior Publication Data

US 2017/0102219 A1 Apr. 13, 2017

Related U.S. Application Data

(60) Provisional application No. 62/239,541, filed on Oct. 9, 2015.

(51) Int. Cl.
*F42B 12/42* (2006.01)
*F42B 27/00* (2006.01)

(52) U.S. Cl.
CPC ..... *F42B 12/42* (2013.01); *F42B 27/00* (2013.01)

(58) Field of Classification Search
CPC ..... F42B 27/00; F42B 12/42
See application file for complete search history.

(56) References Cited

U.S. PATENT DOCUMENTS 3,324,794 A * 6/1967 Walter Gahle ..... F24B 12/48 102/334
3,678,857 A * 7/1972 Evans ..... F42B 12/50 102/368
4,932,328 A * 6/1990 Pinkney ..... F42B 8/26 102/368

(Continued)

OTHER PUBLICATIONS

Powerpoint Presentation Entitled: "U.S. Army's Search for an Economical Device for Stun Hand Grenade Training", NDIA International & Joint Services Small Arms Symposium, 19 pages, May 18, 2005.

(Continued)

*Primary Examiner* — Stephen Johnson
*Assistant Examiner* — Joshua T Semick
(74) *Attorney, Agent, or Firm* — Fay Sharpe LLP

(57) ABSTRACT

A stun grenade includes a cartridge having an explosive charge in communication with a fuse and a housing including a closed end, an open end, a longitudinal axis and including an internal cavity which accommodates the cartridge. An end cap is attachable to the open end of the housing, the end cap including an end wall and a side wall. A plurality of spaced first vents are defined in the end wall of the end cap. A plurality of spaced second vents is defined in an end wall of the housing. The output from an explosive charge is optimized by vents having a straight flow path. The vents have a first end in fluid communication with the cavity and a second end in fluid communication with an exterior periphery of the housing.

20 Claims, 7 Drawing Sheets

(56) References Cited

U.S. PATENT DOCUMENTS

| | | | | |
|---|---|---|---|---|
| 5,222,798 | A * | 6/1993 | Adams | F21V 33/0064 102/355 |
| 5,654,523 | A * | 8/1997 | Brunn | E42B 8/26 102/368 |
| 5,700,971 | A * | 12/1997 | Rayer | F42B 12/48 102/334 |
| 7,278,806 | B1 * | 10/2007 | Clayton | B23C 3/12 144/347 |
| 7,721,651 | B2 | 5/2010 | Lübbers et al. | |
| 7,963,227 | B1 * | 6/2011 | Brunn | F42B 8/26 102/360 |
| 8,161,883 | B1 * | 4/2012 | Harasts | F41A 33/04 102/361 |
| 8,915,190 | B2 * | 12/2014 | Kravel | F42B 12/48 102/334 |
| 9,151,584 | B2 * | 10/2015 | Kapeles | F42B 8/26 |
| 9,261,339 | B2 * | 2/2016 | Mancini | E42B 12/42 |
| 9,488,454 | B2 * | 11/2016 | Kravel | E42B 12/50 |

OTHER PUBLICATIONS https://www.combinedsystems.com/products/?cid=16, CTS Flash Bangs & Sting-Ball Grenades, 1 pages, Apr. 19, 2016.
http://www.inetres.com/gp/military/infantry/grenade/hand.html, "Hand Grenades, Gary's U.S. Infantry Weapons Reference Guide", 25 pages, May 18, 2016.

* cited by examiner

LOW-WEIGHT SMALL-FORM-FACTOR STUN GRENADE

This application claims the benefit of Provisional Application Ser. No. 62/239,541 which was filed on Oct. 9, 2015. The entire content of that application is incorporated hereinto by reference.

BACKGROUND

This disclosure relates to a tactical device used during hostage rescue and high-risk warrant arrests and the like where law enforcement or military personnel need to distract suspects during their operation upon entering a suspect area. The device produces a blaring noise and a brilliant light upon detonation. The disclosure is particularly suited to a non-reusable stun grenade when activated but which permits charge changes if needed in the grenade at a later date if the grenade has not been used. The device incorporates both a novel port design and manufacturing design which avoids crimping or other means of fastening. The design of the device permits a lower weight device than those currently in the art, thereby significantly reducing the body weight of the grenade, and allowing those personnel needing to carry such a device the ability to carry more of them. In addition, the design further permits aluminum alloys to be used for construction instead of ferrous materials thereby permitting even more weight reduction. Performance to weight ratio of such devices can be extremely important for those needing to carry and use such a device. The port design improves the pressure sound levels by an order of magnitude while also increasing the luminosity. The performance to weight ratio is increased to around 1.5 times over any known previous prior art.

Stun grenades, otherwise known as flash bangs, are well known in the art. Prior art devices include those made by Combined Systems Inc. under U.S. Pat. No. 5,654,523. This patent describes a grenade which is made from a housing having a top and a bottom end section. Such a device requires an explosive charge to be loaded during manufacture and prior to assembly of at least the top or bottom section which is then permanently swaged or fastened into place. Eliminating the swaging operation is desirable from both a manufacturing and end use perspective. Swaging operations are typically slow. Law enforcement or military personnel must also carry such a device and, thus, a smaller lighter weight housing is also desirable, provided that the performance of the device which is measured by the luminosity and pressure stays the same.

The United States military also uses stun grenades, such as the well-known M84 device. Training can be expensive and, thus, the ability to have a stun grenade which mimics actual production and is reusable would be desirable. There is also a need for improved performance in both luminosity, as well as pressure level, but without increasing the weight of the grenade. While straight walls on the body of a grenade are adequate for handling, improved ergonomics can assist in assuring hand location, as well as in handling, while throwing the grenade, especially for grenades where the products do not expel from the side walls, such as in the M84 device. There is thus a need for a lighter weight tactical device having a performance equal to or greater than currently available products, but which also has improved ergonomics.

BRIEF SUMMARY

According to one embodiment of the present disclosure, a stun grenade comprises a cartridge including an explosive charge in communication with a fuse and a housing made of an aluminum alloy material including a closed end, an open end and a longitudinal axis, wherein the housing includes an internal cavity which accommodates the cartridge. An end cap made of an aluminum alloy material is adapted to be selectively attached to the open end of the housing to close same, the end cap including an end wall and a side wall. A plurality of spaced first vents extends through the end wall of the end cap. A plurality of spaced second vents extends through an end wall at the closed end of the housing. At least some of the material of at least one of the housing and the end cap is ablated away during a firing of the stun grenade, thereby increasing a luminosity in candelas of the stun grenade during its firing by at least 50 percent.

In accordance with another embodiment of the present disclosure, a stun grenade comprises a cartridge including an explosive charge in communication with a fuse and a metal housing, including a closed end, an open end and a longitudinal axis, the housing including an internal cavity which accommodates the cartridge. A metal end cap is adapted to be selectively attached to the open end of the housing to close same, the end cap including an end wall and a side wall. A plurality of spaced first vents extends through the end wall of the end cap. A plurality of spaced second vents extends through an end wall at the closed end of the housing. The plurality of first vents and the plurality of second vents a) extend generally parallel to the longitudinal axis of the housing and b) have a first end in fluid communication with the cavity and a second end in fluid communication with an exterior periphery of the housing. At least one of a material of the end cap and a material of the housing is so chosen that the chosen material is adapted to be ablated away during a firing of the stun grenade, thereby increasing a Cv factor of the stun grenade from an initial value.

In accordance with a still further embodiment of the present disclosure, there is provided a stun grenade comprising a cartridge, including an explosive charge in communication with a fuse and an aluminum alloy housing, including a closed end and an open end and a longitudinal axis, the housing including an internal cavity which accommodates the cartridge. An aluminum alloy end cap is adapted to be mounted to the open end of the housing to close same, the end cap including an end wall and a side wall. A plurality of spaced first vents extends through the end wall of the end cap. A plurality of spaced second vents extends through an end wall at the closed end of the housing.

If desired, a material of the end cap surrounding at least one of the plurality of spaced first vents can be made to expand outwardly during a firing of the stun grenade to further engage the end cap with the housing so that the end cap is further constrained from being separated from the housing during the firing of the stun grenade. Alternatively, either in combination with the material expansion of the vents or completely independent from the vent expansion, radial deflection of the grenade housing in its mid body portion can be made to cause the housing top wall near the end cap to deflect inwardly. This causes a pinching action on the end cap to keep it from being separated from the housing during the firing of the stun grenade.

BRIEF DESCRIPTION OF THE DRAWINGS

The invention may take physical form and certain parts and arrangements of parts, several embodiments of which will be described in detail in this specification and illustrated in the accompanying drawings which form a part hereof and wherein.

DETAILED DESCRIPTION

Figure 1:
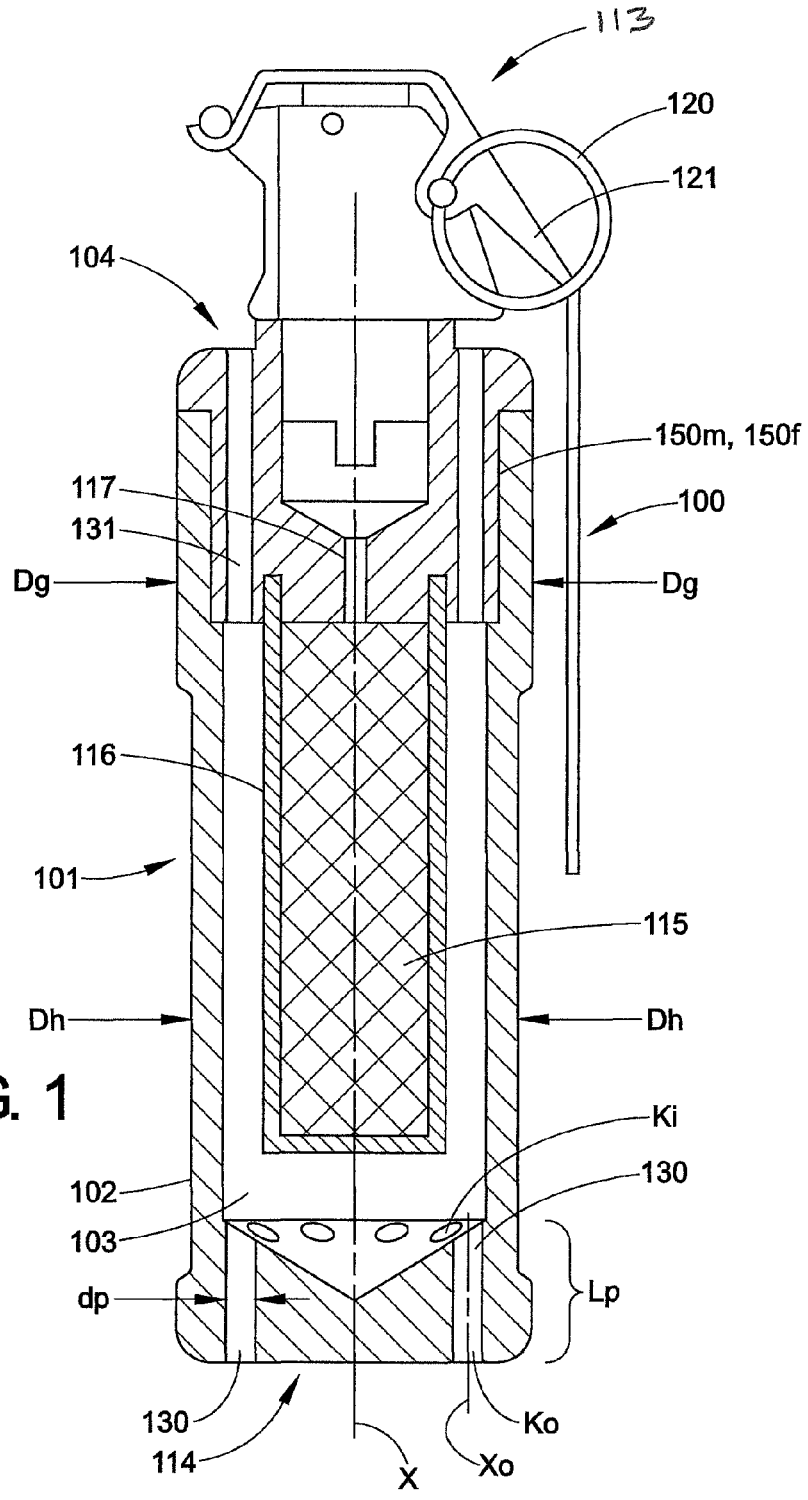
FIG. 1 is a cross sectional view of a stun grenade according to one embodiment of the present disclosure.

Referring now to FIG. 1, a stun grenade 100 according to one embodiment of the present disclosure is shown. As shown, the grenade 100 has a housing 101 with a longitudinal axis X about which much symmetry can be seen with a fuse assembly 113. The grenade housing 101 is cylindrical in this embodiment having a side wall 102 which can have more than one diameter, if desired. As shown, the housing 101 has two diameters Dg and Dh, where the respective diameters include a larger diameter for the ends of the grenade housing and a smaller diameter between the ends for a hand hold to prevent slippage when either the hand or grenade might be wet. Defined in the housing 101 is cylindrical cavity 103 capped at the ends by a top end wall or end cap 104 and bottom end wall 114. These ends can be domed, conical, or made flat. Bottom end wall 114 can in one embodiment be contiguous or of one piece with the side wall 102, although it could be made as a separate piece and joined by fastening to side wall 102 by many means such as electromagnetic forming, friction welding, threading, or the like. In the disclosed embodiment, the bottom end wall 114 and side wall 102 are made as a continuous or unitary piece that is machined, forged, or made by hydrosolidification. Domed walls may be employed to optimize material weight and stress reduction when possible. Top end wall or end cap 104 is fastened to side wall 102 in this embodiment by threads 150*f* and 150*m*, where 150*f* is a female thread and 150*m* is a male thread. Although the threads can be of the same pitch and diameter, it is also contemplated that the threads need not match exactly but may provide a small interference fit for sealing purposes. Although in one embodiment fastening of the top end wall or end cap 104 to the side wall 102 is described and preferred to be a connection structure in the form of interengaging threading so as to allow removal of a cartridge 116 held in the cavity 103, in some cases it may prove to be beneficial to have other means of fastening that are permanent. For this purpose, threads may still be used if a thread locking compound is used.

The cylindrical cavity, although not shown as being sealed contains the cartridge 116 which includes an explosive charge 115. Explosive charge 115 is detonated by a fuse (not shown for simplicity) when a safety pin 120 is pulled and a lever 121 is also pulled. This ignites a flash charge after a preset delay. When ignited, the spark generated by the fuse travels through a flash hole 117 which in turns ignites the explosive charge 115 contained in the cartridge 116. Cartridge 116 can be friction mounted, clamped, glued or otherwise fastened to the top end wall or end cap 104. When the charge 115 detonates, the products of combustion are expelled through both bottom orifice ports or vents 130 and top orifice ports or vents 131. As shown, these can each have a longitudinal axis Xo such that the several axes are oriented generally parallel to the housing axis X. An optimum orientation will be discussed below.

The ports 130, 131 shown in FIG. 1 are referred to as square edge orifices on the outlet side where the products of combustion are expelled to atmosphere since from experimental work such orifices are shown to provide very good results. Although square edged, the holes are deburred and thus a small chamfer or fillet of about 0.010 inch is expected. In addition, other orifice outlet geometries such as venturi or conical outlets are perfectly acceptable and within the scope of this disclosure. As shown in FIG. 1 orifice ports 131 and 130 need not be equal in diameter or in length, or have the same shape. Even different numbers of ports can be provided on the top end wall 104 versus the bottom end wall 114 as long as the momentum transfer of the explosive charge is balanced in such a manner that the grenade 100 does not act as a projectile itself from the detonation. In this regard, the products of combustion are discharged along the longitudinal axis X of the device 100, and the momentum transfer is controlled by a number of factors. These include the entrance coefficient of orifice ports (Ki), the diameter of the ports (dp), the length of the ports (Lp), and exit coefficient of the orifice ports (Ko). The main advantage of discharging along the housing longitudinal axis X is that pressure drop is minimized, all other factors being equal. This, therefore, significantly increases the performance of the device 100, increasing its output pressure and luminosity. In addition, the ports being oriented parallel to the housing axis X can further simplify machining operations. However, slight off axis ports are certainly within the scope of the present disclosure.

Figure 2:
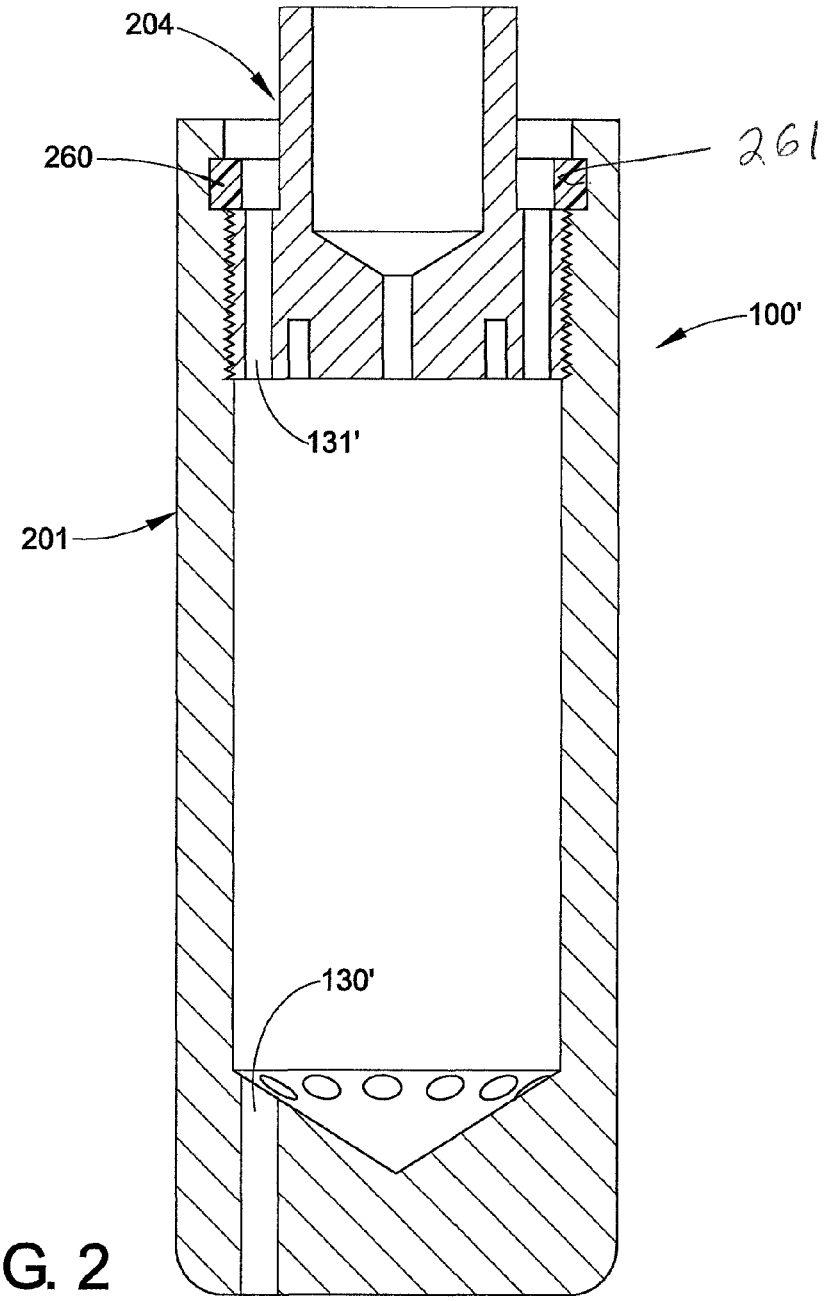
FIG. 2 is a cross sectional view of a stun grenade housing showing an alternative to threading a top end wall according to another embodiment of the present disclosure.

Referring now to FIG. 2, this figure shows the body of a grenade 100' according to another embodiment of the present disclosure. In this embodiment, an alternative means is shown for fastening a top end wall 204 to the grenade or tactical device 100'. This is accomplished by using a connection structure in the form of a spiral internal ring, connecting ring or other fastening clip 260 that engages in a groove 261 of a housing 201 for retaining the top end wall 204 in place. In this case the top end wall 204 can engage with housing 201 with or without an interference fit. In addition, while a threaded engagement is illustrated in FIG. 2, no such threading is necessary if the internal ring alone secures the top end wall 204 in place on the housing 201. The top end wall 204 can be securely retained by the internal ring 260 or a similar connection structure. While the internal ring can be made of metal, other known materials for the ring are also contemplated. It is noted that in this embodiment, axially oriented vents 130' and 131' are defined in a bottom wall of the housing 201 and in the top end wall 204, respectively.

According to still another embodiment of the present disclosure, an end cap can be provided for each of the opposed ends of a cylindrical or tubular housing so as to close off each of the ends individually if so desired. In one embodiment, a threaded interengagement of the respective end caps with suitably threaded ends of a housing can be provided. In another embodiment, an alternative means for fastening the end caps to the housing can be employed, such as is illustrated in FIG. 2 herein. Providing end caps at both ends of a cylindrical housing is less advantageous, however, than providing or forming a housing which has one end already closed so that only a single end cap needs to be secured to the housing as this can expedite the assembly of the stun grenade.

Figure 3:
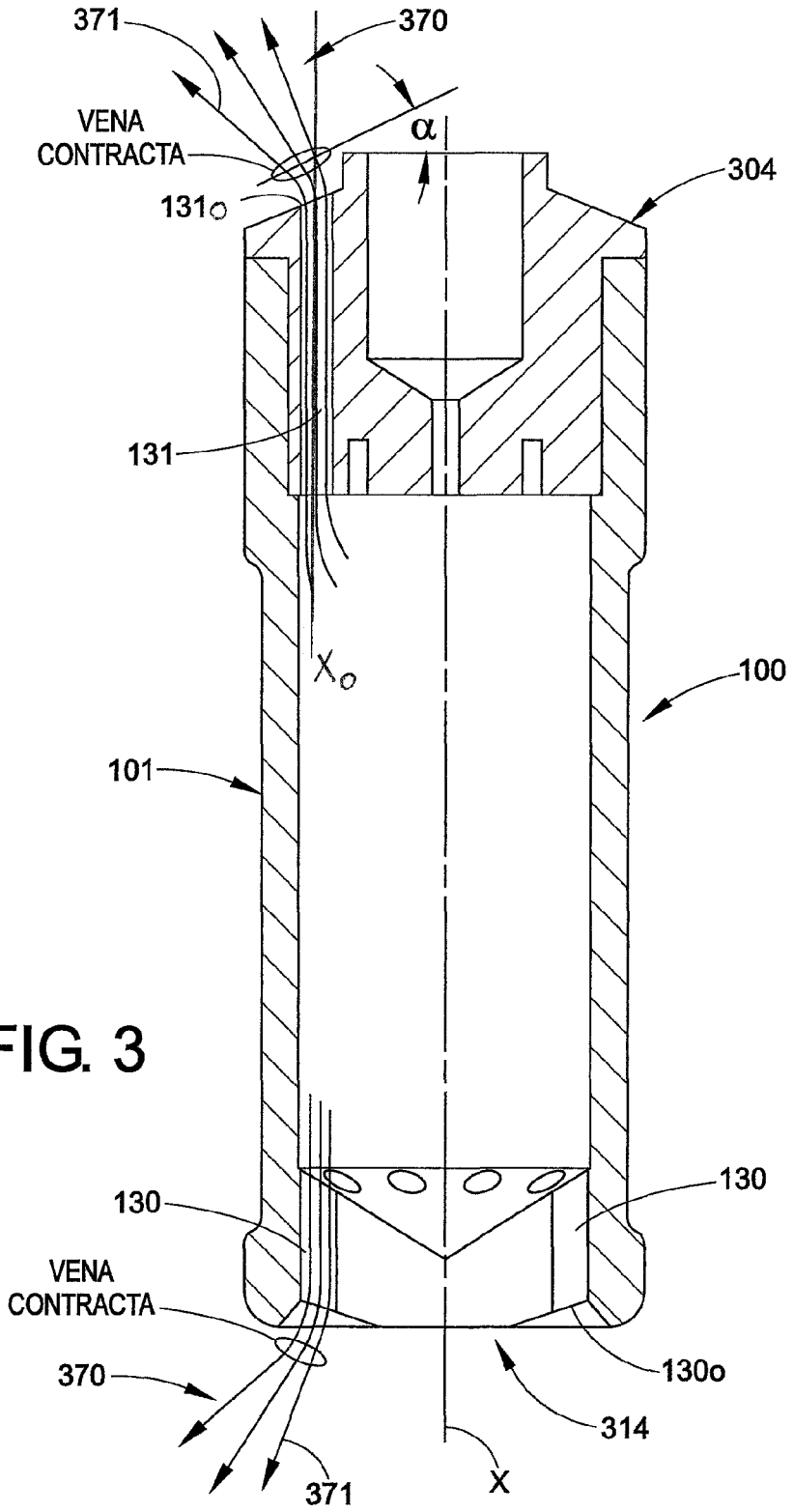
FIG. 3 is a cross sectional view showing exhaust product flow direction as being directed by the outlet configuration of the orifice ports according to an embodiment of the present disclosure.

Referring now to FIG. 3, although directional control of the exhausting products of combustion 370 is not necessary to achieve balance in this embodiment, some performance characteristics can be improved by controlling the vena contracta location by modification of the orifice's port outlets 130*o*, and 131*o*. This modification can be an alternative to ports that are off axis with respect to the longitudinal axis of the device. In addition, the present modification to the orifice's port outlets 130*o* and 131*o* can also be combined with an off axis port. As shown in FIG. 3, the modification to the orifice port is such that the longitudinal axes Xo of the orifice holes 130, and 131 are parallel to the longitudinal axis of the housing 101, but the perimeter of the orifice outlet is elliptical in shape, being that each outlet is located at an angle to the longitudinal axis X since the face of the top end wall 304 and the face of the bottom end wall 314 are each not oriented perpendicular to the longitudinal axis X of the housing. Rather, they are inclined at an angle ($\alpha$). Thus, as is shown by the combustion product's streamlines of flow 371, the angle will tend to cause the flow to also exit at an angle. This orientation is an advantage as this allows another means to distribute the charge even if by a very small amount (less than about 9 degrees with respect to the device's longitudinal axis X) while not decreasing the pressure and luminosity of the device.

Figure 4:
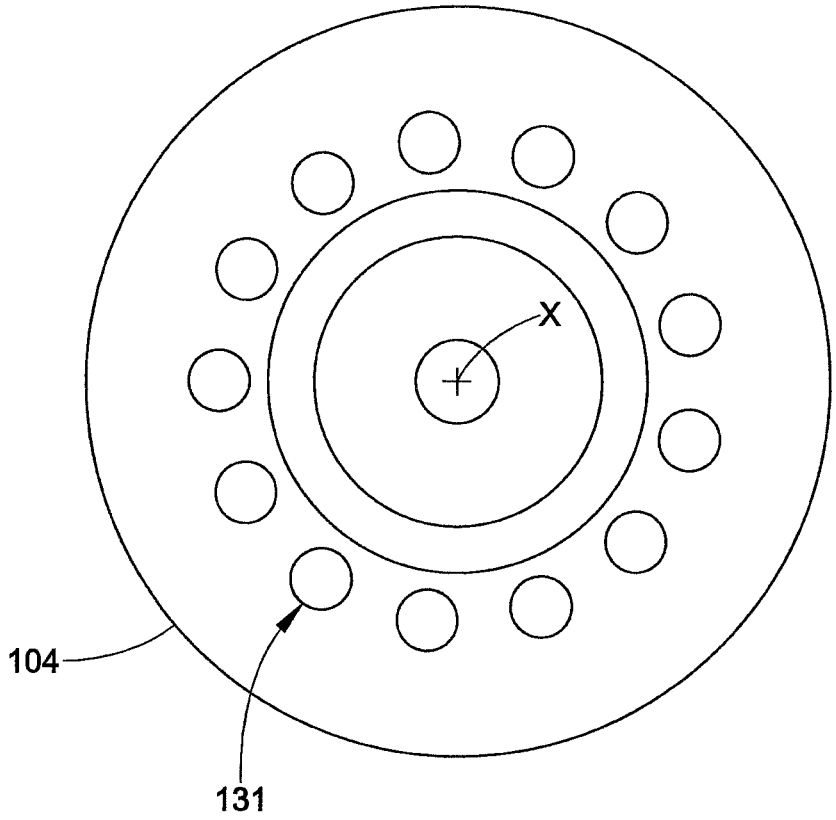
FIG. 4 is a planar view of a top end wall of a stun grenade housing of FIG. 1 showing several orifices.

Referring now to FIG. 4, this figure shows a planar view of the end cap or top end wall 104 of the device of FIG. 1, showing a general distribution of orifice ports 131. The ports 131 are spaced apart and radially distributed about longitudinal axis X. As mentioned, the ports 131 need not be distributed equally but can be grouped so that combustion discharge is not blocked by the fuse (not shown) when the grenade is detonated.

Figure 8:
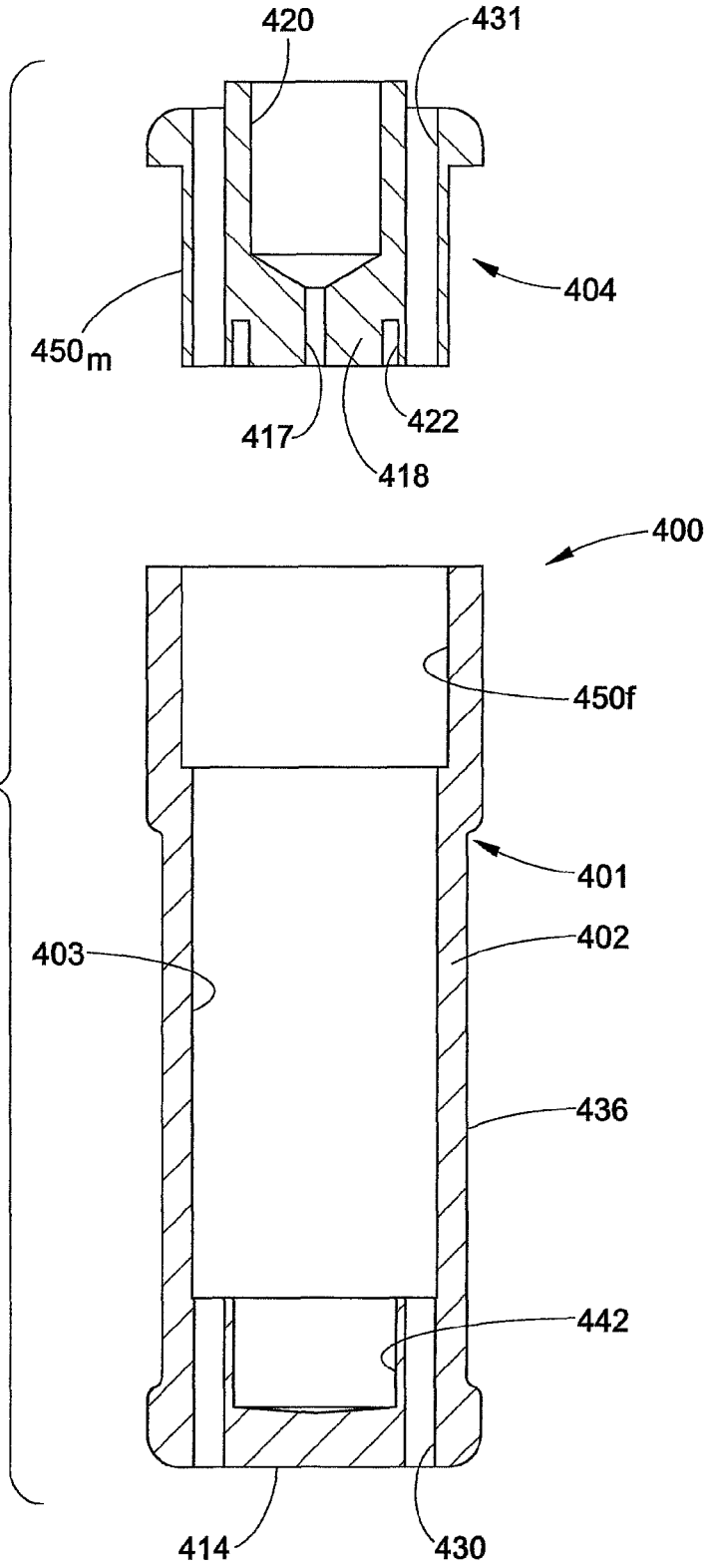
FIG. 8 is an exploded side elevational view in cross section of the stun grenade of FIG. 5.

With reference now to a further embodiment of the present disclosure, FIG. 8 illustrates a stun grenade 400. In this embodiment, the grenade 400 is provided with a housing 401 including a side wall 402 and a bottom wall 414, which together define a cylindrical cavity 403. The cavity can be selectively closed by an end cap 404.

Figure 5:
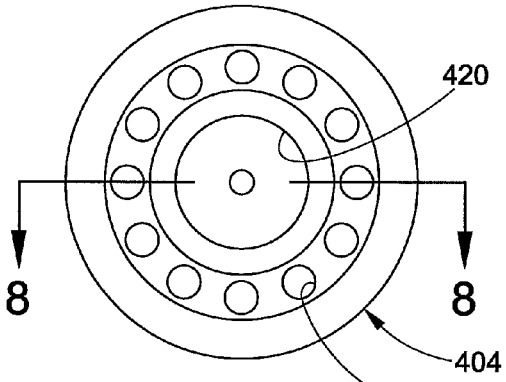
FIG. 5 is a top plan view of a stun grenade according to another embodiment of the present disclosure.
Figure 6:
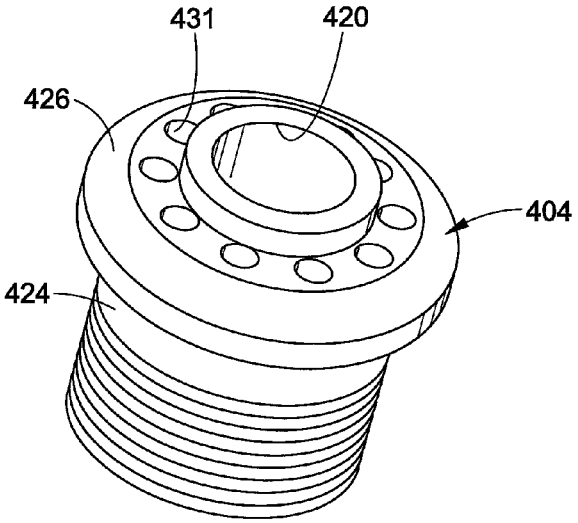
FIG. 6 is a perspective view of an end cap for the stun grenade of FIG. 5.

With reference now to FIGS. 5, 6 and 8, the end cap 404 can comprise a body which includes a flash hole 417 that extends axially through an inner section 418 and communicates with a fuse opening 420. Also defined in the body is an annular bore 422 for accommodating an upper end of a cartridge (not illustrated in this embodiment). Extending axially through the end cap 404 are a plurality of spaced vent holes or vents 431. In one embodiment, twelve radially spaced vents are provided as is evident from FIG. 5. Of course, it should be recognized that a variety of other numbers and configurations of vents can also be employed. Defined on an outer periphery of a lower section 424 of the end cap and beneath an annular flange 426 thereof is a threaded section 450*m* which can include male threads of a variety of configurations that engage with female threads 450*f* in the housing 401.

Figure 7:
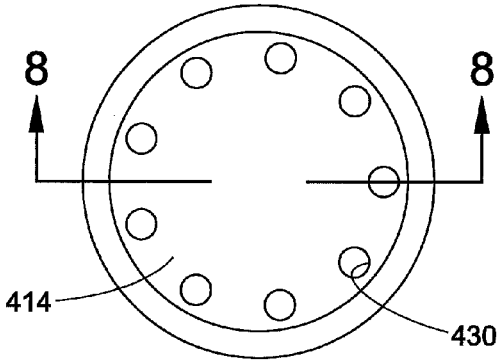
FIG. 7 is a bottom plan view of the stun grenade of FIG. 5.

With reference now to FIGS. 7 and 8, the housing 401 includes a plurality of vents 430 extending through the bottom end wall 414. In one embodiment, nine such vent holes can be provided. In another embodiment, the number of top vents 431 can be upwards of 18 holes with a diameter of near 0.146 inches. Even more holes can be added if the diameter of the holes is decreased. For example, in a further embodiment, nearly 30 holes can be provided if the diameter of each hole is decreased to 0.1 inch. A combination of holes having different diameters might also work. Also, in a still further embodiment, about 10 holes can be provided with a diameter of 0.25 inches, if so desired. In the bottom end wall 414, the number of holes can vary from 5 to 18 holes if they are of the same diameter.

In one embodiment, the vents 431 in the end cap can be 0.146 inches in diameter and 1.12 inches in length. In that embodiment, the vents 430 in the bottom end wall 414 can be 0.136 inches in diameter and 0.740 inches in length. Alternatively, the number of holes in the bottom end wall 414 can also be decreased to a single large hole of about 0.35 inches in diameter, if kept to the same length, as the 5 to 18 holes of the embodiment mentioned above, namely, 0.75 inches in length.

For a square edge hole, the flow coefficient (Cv) will be inversely proportional to the square root of the entrance coefficient which is 1.5. For a smooth radius entrance, the Cv will be about 1. Thus, a square edge hole entrance will flow about 20 percent less fluid for the same pressure drop having the same diameter exit. Cv value is proportional to the diameter of the hole squared, so a bit larger hole will be needed with the hole having a square edge entrance.

A conventional stun grenade has a pressure level of around 175 decibels at 5 feet and a candela measurement, i.e., a brightness measurement, of 3-4 million candelas. In contrast, the stun grenade illustrated in FIGS. 5-8 has a pressure level of about 180 decibels (dB) at 5 feet and a candela measurement of over 7 million candelas. A conventional M84 stun grenade weights 406 grams and a known CTS model 7290M stun grenade weighs 420 grams. The weight of the stun grenade embodiment illustrated in FIGS. 5-8 is about 270 grams. Thus, the design illustrated in the embodiment of FIGS. 5-8 allows for a lower weight stun grenade than does the prior art. The stun grenade of FIGS. 5-8 also provides a louder sound (around 180 dB vs. 175 dB at five feet) and a brighter flash (at least 7 million candelas vs. 3-4 million candelas) than the prior art stun grenades, when the housing and end cap are made of steel (and about 10 million candelas if the housing and end cap are made of an aluminum alloy).

If the body of a grenade according to the present disclosure is made of an aluminum alloy, it can weigh about 150 grams. If the body is made out of steel, the weight can be the same, although the wall thickness is reduced and the tolerances for a housing made of steel have to be higher because the geometry requires thinner walls.

A conventional CTS 7290M stun grenade is 5.4 inches long and has a major diameter of 1.5 inches. The M84 stun grenade is 1.73 inches in diameter and 5.25 inches long. In one embodiment, the stun grenade according to the present disclosure can be about 4 inches in length, with an indented central section 436 (FIG. 8) thereof being about 2.47 inches in length. The overall diameter of the grenade illustrated in FIGS. 5-8 can be on the order of 1.37 inches, with a larger diameter being provided on the two opposed ends of the stun grenade. The change in diameter can be such that the diameter of the indented section can be about 1.20 inches. This indented central section or portion 436 is advantageous to provide better handling characteristics for the stun grenade as it provides the user a more secure and tactical feeling for hand placement. Of course, a variety of other sizes can be employed for the stun grenade if so desired.

As presently understood, any wrought-based aluminum alloy can be used as the material for the housing, the end cap, or both. For example, wrought-based aluminum alloys like the 2000, 6000 or 7000 Series can be employed. Casting alloys, like A356, are also usable. In another embodiment, rather than using an aluminum alloy for the housing of the stun grenade, a steel material can be employed. However, it is anticipated that employing steel for the housing will produce a stun grenade that doesn't flash as many lumens as when the housing is made out of an aluminum alloy.

The vena contracta can be directionally controlled to some extent by a straight drilled hole, as is illustrated in, e.g., FIG. 6. The flow is then directed outward by a few degrees, from 0 degrees to approximately 20 degrees.

In one embodiment, the housing side wall can have a thickness of about 0.135 inches. The housing end wall can have a thickness of about 0.24 inches. The end cap can have a thickness of about 1.12 inches.

The openings/vents can have sharp edges such as roughly 85 degrees, but even 60 degrees may be acceptable.

In one embodiment, the top vents 431 can be located radially very close to the threaded portion of the top wall end cap, namely about 0.040 inches radially inwardly from the threads. As the holes in the threaded end cap open up during the firing of the stun grenade, the material that is in the area of the 0.040 inch thick section of the wall and its vicinity is lost. However, the remaining threads still stay in contact with the housing, thereby keeping the end cap firmly attached to the housing.

In one embodiment, a square type indentation 442 is provided in the bottom end wall 414, as illustrated in FIG. 8. This is in contrast to the embodiment shown in FIG. 1, wherein a conically shaped indentation is illustrated. The conical indentation is provided for stress and strain relief and to provide a larger volume in the interior of the housing. The square bottomed hole or indentation 442 illustrated in FIG. 8 is employed for the same purpose. The bores or bottom vents 430 can be ablated away in the narrowed area defined radially inwardly of the bottom vents 430 in the area of the indentation 442. This ablation occurs towards the interior of the indentation.

Figure 10:
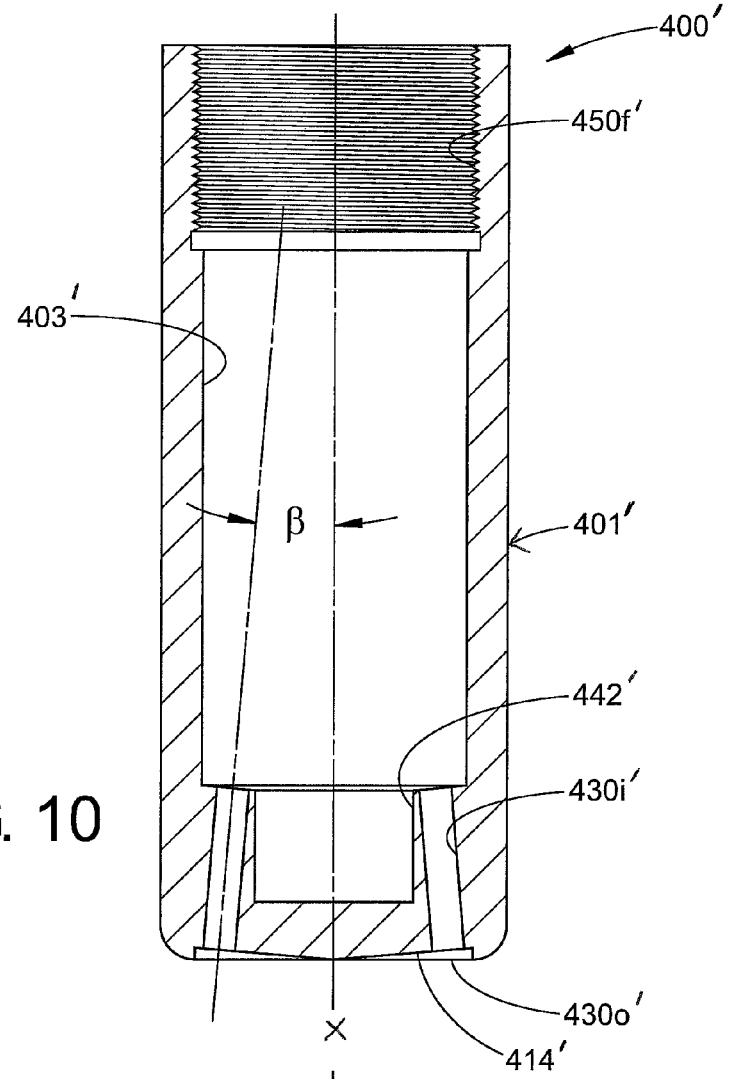
FIG. 10 is a side elevational view in cross section of the stun grenade housing of FIG. 9.
Figure 9:
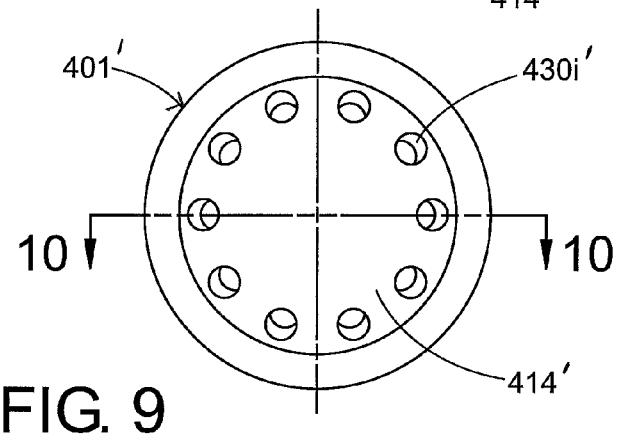
FIG. 9 is a bottom plan view of a stun grenade housing according to another embodiment of the present disclosure.

While the previous embodiments have shown top and bottom vents which extend parallel to a longitudinal axis of the housing, the embodiment illustrated in FIGS. 9 and 10 shows off axis vents or openings. For ease of understanding, like components in this embodiment are identified with a primed (') suffix. Shown in FIG. 9 is a bottom plan view of a stun grenade housing 401' with bottom vents **430*i*'. As illustrated in FIG. 10, the bottom vents 430*i*' are inclined to a longitudinal axis X of the housing 401' by an angle B which can be up to about 12 degrees. In like manner, top vents of the grenade which are defined in a cap (not illustrated) that can be mounted to the housing 401' via threads 450*f*' defined in an inner wall 403' of the housing can also be inclined. FIG. 10 also illustrates that the bottom end wall 414' is conically shaped. In one embodiment, the face of the bottom end wall 414' is shown to be oriented perpendicular to vent outlet 430*o*' so that the outlet is round as shown in FIG. 9. However, the vent outlet 430*o*' need not be round and can be elliptical in shape as illustrated in the embodiment in FIG. 3**.

One advantage of the aluminum alloy has to do with the aluminum ablating away. During firing of the stun grenade, the bottom vents 430 change dimensions to about one third of their original length. In the meanwhile, as to the end cap of the grenade, the hole length stays the same but the hole diameter increases. This will also increase the Cv factor. In the embodiment discussed, the mass flow or gases will come out of the stun grenade in a shorter period of time. Thus, the Cv is not constant but increases at the top and bottom ends of the grenade about equally.

As it is fired, an internal pressure in the grenade is decreasing and that would normally cause the mass flow to decrease. In the case of the disclosed stun grenade, however, as the internal pressure drops, the Cv is increasing due to ablation and, thus, the mass flow does not drop as significantly as in prior art designs. To this end, the disclosed stun grenade employs a combination of hole diameter and entrance coefficient and the length of the hole to increase the Cv from its initial value during the beginning of the expulsion of the products from the grenade by causing the aluminum alloy to ablate away thereby increasing the hole diameter, increasing the entrance coefficient and decreasing the length of the orifice hole, respectively. Thus, as the internal pressure in the grenade is dropping, the mass flow does not drop as significantly as in prior art designs (which have fixed Cv outlets), since in the disclosed grenade, the Cv of the outlets increases during the grenade expelling its products of combustion. It is believed that the Cv increases by about 20 to 30 percent.

As mentioned, in one embodiment, the housing can be made of aluminum or an aluminum alloy. However, other known materials for the housing are also contemplated. It is also contemplated that the top end wall or end cap that is fastened to the housing can be made from a different material or a different alloy than the remainder of the housing. In another embodiment, the top and bottom end walls can be made of a different material or alloy than the side wall of the housing.

Aluminum alloy having a lower yield stress than that of steel can be used to lighten the design with an equivalent charge as that of a larger diameter grenade, provided the housing diameter is reduced to lower the hoop stresses in the walls when compared to an equivalent wall made of steel. Using an aluminum alloy has the other advantage in that over-charging the grenade becomes self-correcting during detonation as the ports enlarge because the melting point of the alloy is lower than the charge's combustion temperature. Thus, the ports themselves ablate during the discharge. Their diameter increases, and thus the housing is relieved of higher pressures that could potentially cause a rupture of the housing.

When comparing a steel housing versus an aluminum alloy housing with the same sizes and numbers of holes, a stun grenade made of an aluminum alloy (Sample 3) had a significantly larger (almost twice as large) candela output as did two specimens (Samples 1 and 2) of the stun grenade having a steel housing as indicated below:

| | Sample 1 | Sample 2 | Sample 3 |
|---|---|---|---|
| Average dB | 179.79 | 180.89 | 180.3 |
| Candelas | 4.88 million | 5.22 million | 10 million |

In sum, as the aluminum ablates away, it reacts with the material being expelled from the stun grenade, causing a higher light output than does a steel housing. Thus, not only is an aluminum alloy housing beneficial from the perspective of being lighter than is a stun grenade with a steel housing, but a stun grenade having an aluminum housing will also provide a much brighter flash than the same design of a stun grenade made with a steel housing.

There are several objectives which need to be fulfilled by a stun grenade according to the present disclosure. First, the dB level of the stun grenade needs to be at about the same dB level as are other stun grenades. While there is no maximum dB level, the preferred level is about 180 dB, as dB levels above that number may rupture the ear drums of people standing adjacent to the exploding stun grenade. For a given size charge, one wants to increase the dB levels so that the charge pressure is minimized. In other words, it is desirable to maximize the dB level while minimizing the explosive charge. This facilitates a lower weight grenade, as stresses are less on the body of the grenade. Second, it would be advantageous for the stun grenade to be light in weight, for the reasons explained above. A stun grenade housing made of an aluminum alloy would meet this need. With these two limitations in mind, one way of increasing the functionality of the stun grenade is to increase its luminosity. Making the material of at least one of the housing and the end cap from an aluminum alloy material while keeping the explosive charge the same size enables the stun grenade according to the present disclosure to be lightweight with a significantly increased luminosity, i.e., a luminosity which is perhaps 50 percent greater than the luminosities of known stun grenades, and up to 50 percent larger than the luminosity of a stun grenade according to the present disclosure, but having a steel housing. In this way, an advantageous stun grenade can be provided which has an increased luminosity, which is lightweight and which maintains a high dB level.

It should be apparent that the aluminum alloy employed in at least one of the housing and the end cap can ablate away during the flow of combustion products out through the vents or holes in the stun grenade. This flow increases the luminosity of the stun grenade enhancing the efficiency of the use of the lightweight stun grenade according to the present disclosure.

During discharge, the pressures can be significant. In one embodiment, the arrangement is such that the orifice holes in the top wall housing are located very close to the threaded portion of the top wall or end cap. Because the distance from the wall of the orifice to the thread is small, the high pressures built up during discharge cause the thinnest portion of the orifice retaining material to yield. This, itself, causes a temporary self-jamming/wedging action of the end cap or top wall housing to the mating threaded wall of the main housing. At the same time, this provides better transient heat transfer, thus causing a portion of the thread to remain strong so as to withstand the pressure while a portion of the end cap or top wall becomes weak and can even turn into sacrificial material, i.e., may be ablated away. Meanwhile, and independent of this wedging action of the end cap to top wall as just described, during detonation of grenade, the pressure in the main body of the grenade causes high hoops stress/strain in the housing walls, causing them to deflect outwardly away from the grenade housing center axis X. This outward radial deflection mid-body of the grenade housing however causes an inward deflection near the top wall of the housing near the end cap (the end cap portion of the housing wall does not see per se the same internal pressure). This boundary condition at the housing upper end with the end cap thus causes the housing top wall near the end cap to deflect inwardly, thereby also causing a pinching action on end cap. This action also serves to more firmly hold the end cap on the housing.

In the embodiments shown, discharge occurs from vents or openings located in the top and bottom end walls of the grenade housing. Such openings can have sharp edge orifices at their output end. The inlets to the orifices although shown as sharp edge and square need not be made sharp edge. The orifices though generally include a long hole such that the length to diameter ratio can be greater than 2 to 1 when using aluminum material for the housing and the end cap. The longitudinal axis of the orifice can be oriented parallel to the longitudinal axis of the device. The outlets of the several orifices are not counter bored or extensively chamfered other than for machine operations of deburring.

In the prior art stun grenade designs, the detonation charge's combustion products are forced to exit at an angle from the longitudinal axis of the housing because the walls in the vent are oriented at an angle. In other words, the physical flow path of the vent causes the products to exhaust at an angle. The preference in prior art is to vent radially from or at an acute angle in relation to the longitudinal axis of the housing. In the prior art devices, the physical flow path causes the combustion products to exit at an angle, but this comes at the expense of a pressure drop that is detrimental to performance of the device in terms of pressure and luminosity. In the instant disclosure, to increase the output noise and the luminosity, a straight path is preferred as this significantly minimizes the pressure drop and maximizes the discharge's output for any given charge level (pressure). The current disclosure optimizes the output characteristics to the amount of charge by a straight flow path, i.e. a drilled hole (whether off axis or parallel to the device's longitudinal axis), which also is beneficial as holes are better for reduced pressure drop.

It is highly desirable to keep the grenade from moving violently during detonation of the discharge. The momentum from the discharge must therefore be balanced at the top and bottom ends of the housing. In prior art designs, radial venting of the discharge provided for little to no momentum transfer along the longitudinal axis, and thus the advantage of the prior art design is a balanced design but at the expense of performance.

To greatly reduce and ideally eliminate the possibility of the top housing wall becoming a projectile, threads are the preferred choice for retaining the upper wall with the housing as this permits the explosive charge to be safely loaded, and then the top housing wall to be screwed or threaded into place. Other means of fastening are also contemplated such as the use of an internal retaining ring, or the like. And, although swaging can certainly be done, a threaded fastening system has advantages because it decreases assembly time in production.

In the current disclosure, to retain the high force imparted to the top wall of the housing requires a length of thread that increases the length of the top wall housing, and therefore the length of the top wall, orifice or hole is longer than that of the bottom wall, orifice or hole. It is of course desirable to keep weight minimized, and thus the bottom wall housing thickness need not be as great as the top wall housing, otherwise one can add material to simply balance the momentum (longer holes on the bottom). Weight reduction (as well as size) therefore significantly compounds the problem of trying to balance the momentum from the top of the device with the momentum from the bottom of the device. Thus when optimizing for weight and size with a threaded top wall, the disclosed design permits momentum balancing by increasing the diameter of the holes located in the top wall when a desired number of holes are located in the bottom wall. The number of holes or vents can be the same in the bottom wall as in the top wall or end cap. However other configurations are also possible. For example, keeping the diameter of the orifices the same on both the top and bottom walls, the momentum can be balanced by increasing the number of holes in the top wall to equalize the flow of the combusted products from the bottom orifices. One way of doing this is by increasing the orifice diameter since this will give better momentum control and lends itself well to manufacturing.

Alternatively or in combination with the above diameter changes, and number of holes, other means of momentum balancing can also be used to accomplish the same objective. For example, one can change the entrance coefficient of the orifices on the top wall from those on the bottom wall as this will also change momentum. In one embodiment, if the top orifice inlets are changed from a square edge to that of a chamfered edge, this will increase the entrance coefficient of the top holes, and if properly set, then the diameters and number of holes at the top and bottom walls can be the same. Likewise, a combination of holes, diameters, and entrance coefficients can be used to balance the momentum.

Although directional control is not necessary to achieve balancing as just indicated, some performance characteristics can be improved by controlling the vena contracta (the point in an orifice where the diameter is the smallest and, hence, the velocity of a fluid stream flowing past that point is the highest). Depending on the charge, the shock wave location can be changed by modifications to the orifices outlet. That is, the hole is straight, but the orifice outlet perimeter can be made to be elliptical in shape being that the top or bottom wall is at an angle with respect to the orifice hole's longitudinal axis, thereby the orifice outlet can still have a sharp edge, but have an elliptical shape, while still being made by drilling. Depending on the elliptical shape, the flow length and shear forces at the orifice outlet will be unbalanced which causes a 'tilt' in the vena contracta with respect to the longitudinal axis of the orifice hole and thus places the vena contracta flow cross section at an angle with respect to the longitudinal axis of the device. This can be an advantage as it allows another means to distribute the charge while not decreasing the pressure and luminosity of the device.

The design has the inherent manufacturing benefit of being able to optimize the performance for different charges (different detonation characteristics) including the size of the charge for a specific type of charge by using standard machining operations, including operations which make a smaller orifice hole, which can be easily increased to a larger diameter hole either during assembly operations or possibly in the field if necessary.

The present disclosure pertains in one embodiment to a tactical device including a two piece housing design, preferably made from aluminum or an aluminum alloy where the bottom wall or end wall is contiguous with or of one piece with the side wall of the housing. In other words, the end wall and side wall of the housing are unitary.

Disclosed has been a low weight small form factor stun grenade which includes a housing and an end cap. In one embodiment, the end cap is selectively detachable from the housing so that an explosive cartridge held in the housing can be replaced. Ports or vents are defined in both the end cap and a bottom wall of the housing. These ports or vents can extend parallel to a longitudinal axis of the housing. The ports or vents are so constructed as to balance the momentum from the top of the grenade with the momentum from the bottom of the grenade when the explosive charge is exploded.

The exemplary embodiments have been described herein. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A stun grenade comprising:

a cartridge including an explosive charge in communication with a fuse;

a housing made of an aluminum alloy material including a closed end, an open end and a longitudinal axis, wherein the housing includes an internal cavity which accommodates the cartridge;

an end cap made of aluminum alloy material, the end cap being adapted to be selectively attached to the open end of the housing to close same, the end cap including an end wall and a side wall;

a plurality of spaced first vents extending through the end wall of the end cap;

a plurality of spaced second vents extending through an end wall at the closed end of the housing; and wherein at least some of the aluminum alloy material of at least one of the housing, at the plurality of spaced second vents, and the end cap, at the plurality of spaced first vents, is ablated away during a firing of the stun grenade thereby increasing a luminosity of the stun grenade as measured in candelas to about 10 million candelas.

2. The stun grenade of claim 1, wherein at least some of the plurality of spaced first vents and plurality of spaced second vents a) extend generally parallel to the longitudinal axis of the housing and b) have a first end in fluid communication with the internal cavity and a second end in fluid communication with an exterior periphery of the housing.

3. The stun grenade of claim 1, wherein a material of the end cap surrounding at least one of the plurality of spaced first vents expands outwardly during a firing of the stun grenade to further engage the end cap with the housing so that the end cap is further constrained from being separated from the housing during the firing of the stun grenade.

4. The stun grenade of claim 1, wherein the end cap and the housing have threaded portions which interengage in order to selectively secure the end cap to the housing.

5. The stun grenade of claim 1, further comprising a fastening ring or clip which removably connects the end cap to the housing.

6. The stun grenade of claim 1, wherein outlet ends of at least some of the plurality of spaced first vents and plurality of spaced second vents are chamfered.

7. The stun grenade of claim 1, wherein outlet ends of at least some of the plurality of spaced first and second vents are oriented at an acute angle in relation to a longitudinal axis of the respective vent.

8. The stun grenade of claim 1, wherein the plurality of spaced first vents and plurality of spaced second vents differ from each other in at least one of number, diameter and length.

9. The stun grenade of claim 1, wherein a top surface of the housing closed end includes an indented area, wherein the housing longitudinal axis extends through the indented area.

10. The stun grenade of claim 1, wherein at least one of the plurality of spaced first vents is located radially inwardly of threads defined on the end cap side wall by about 0.040 inches.

11. The stun grenade of claim 1, wherein during a detonation, the housing open end deflects inwardly pinching the end cap and holding the end cap more securely on the housing.

12. A stun grenade comprising:

a cartridge including an explosive charge in communication with a fuse;

a housing including a closed end, an open end and a longitudinal axis, the housing including an internal cavity which accommodates the cartridge;

an end cap adapted to be selectively attached to the open end of the housing to close same, the end cap including an end wall and a side wall;

a plurality of spaced first vents extending through the end wall of the end cap;

a plurality of spaced second vents extending through an end wall at the closed end of the housing;

wherein the plurality of first vents and the plurality of second vents a) extend generally parallel to the longitudinal axis of the housing and b) have a first end in fluid communication with the cavity and a second end in fluid communication with an exterior periphery of the housing; and wherein at least one of a material of the end cap and a material of the housing is so chosen that the chosen material is adapted to be ablated away during a firing of the stun grenade thereby increasing a Cv factor of at least some of the plurality of spaced first vents and plurality of spaced second vents of the stun grenade from an initial value by about 20 to 30 percent.

13. The stun grenade of claim 12, wherein the plurality of spaced first vents and plurality of spaced second vents are different from each other in at least one of length and diameter.

14. The stun grenade of claim 12, wherein at least one of the housing and the end cap are made from a material comprising an aluminum alloy.

15. The stun grenade of claim 12, wherein a top surface of the housing closed end includes an indented area, wherein the housing longitudinal axis extends through the indented area.

16. A stun grenade comprising:

a cartridge including an explosive charge in communication with a fuse;

a housing including a closed end, an open end and a longitudinal axis, the housing including an internal cavity which accommodates the cartridge;

an end cap adapted to be selectively attached to the open end of the housing to close same, the end cap including an end wall and a side wall;

a plurality of spaced first vents extending through the end wall of the end cap;

a plurality of spaced second vents extending through an end wall at the closed end of the housing;

wherein a dimension of at least some of the plurality of spaced first vents of the end cap or the plurality of spaced second vents of the housing is changed during a firing of the stun grenade because a material of at least the one of the end cap and the housing is ablated away during the firing of the stun grenade.

17. The stun grenade of claim 16 further comprising a connection structure for attaching the end cap to the housing wherein the connection structure comprises at least one of interengaging threading defined on the end cap and the housing and a ring or clip.

18. The stun grenade of claim 16, wherein during detonation of the stun grenade at least one of a) a wall of the housing adjacent the end cap deflects inwardly thereby pinching the end cap and holding the end cap more securely on the housing, and b) a material of the end cap surrounding at least one of the plurality of spaced first vents expands outwardly to further engage the end cap with the housing so that the end cap is further constrained from being separated from the housing during the firing of the stun grenade.

19. The stun grenade of claim 16, wherein the vent dimension includes at least one of a vent length and a vent diameter.

20. The stun grenade of claim 16, wherein at least one of the housing and the end cap are made from a material comprising an aluminum alloy.

* * * * *